United States Patent [19]

McDonald et al.

[11] Patent Number: 4,949,795

[45] Date of Patent: Aug. 21, 1990

[54] ROTARY RAPID EXCAVATION SYSTEM

[75] Inventors: William C. McDonald; Gerard T. Pittard; John H. Cohen, all of Houston, Tex.

[73] Assignee: Gas Research Institute, Chicago, Ill.

[21] Appl. No.: 218,946

[22] Filed: Jul. 11, 1988

[51] Int. Cl.[5] ..... E21B 10/46

[52] U.S. Cl. ..... 175/40; 175/323; 175/394; 175/409; 175/410

[58] Field of Search ..... 175/409, 410, 374, 307, 175/323, 394, 386, 46, 40, 50; 172/747, 5, 6; 407/119; 408/44, 45

[56] References Cited

U.S. PATENT DOCUMENTS

| | | | |
|---|---|---|---|
| 2,107,788 | 2/1938 | Hall | 175/374 X |
| 2,267,833 | 12/1941 | McMahan | 175/307 |
| 2,562,841 | 7/1951 | Compton | 175/394 X |
| 2,714,500 | 8/1955 | Snyder | 175/324 |
| 3,372,763 | 3/1968 | Fischer | 175/409 X |
| 3,604,214 | 9/1971 | Turzillo | 175/323 X |
| 3,871,488 | 3/1975 | Sabre | 175/410 X |
| 4,133,389 | 1/1979 | Ruhl et al. | 172/747 X |
| 4,253,533 | 3/1981 | Baker, III | 175/329 |
| 4,363,367 | 12/1982 | Dixon et al. | 175/340 |
| 4,397,361 | 8/1983 | Langford, Jr. | 175/307 X |
| 4,444,278 | 4/1984 | Rocchetti | 175/394 X |
| 4,553,611 | 11/1985 | Lyons | 175/71 |

*Primary Examiner*—Hoang C. Dang
*Attorney, Agent, or Firm*—Neal J. Mosely, Esq.

[57] ABSTRACT

A method of rapid earth excavation without damaging buried pipe, cable or other underground objects utilizes drills and augers having soft cutting edges and/or control of the torque and weight of the boring apparatus. In one embodiment, the bit of a drill, or bottom end of an earth auger is equipped with inserts formed of soft polymeric material. Another embodiment of an earth auger apparatus has soft polymeric material on the leading cutting surface of the flight, or the auger flight may be formed of soft polymeric material. The flexibility and low abrasion of the polymeric material prevents damage to the object contacted. Another embodiment has a dual concentric auger with a small earth-auger rotatably mounted inside the shaft of a larger auger and driven independently such that each is capable of providing and maintaining a torque adequate to create a given hole diameter but sufficiently below that which would damage the object expected to be encountered. Another embodiment has an indicator mounted forward of and below the leading cutting surface of the auger to warn the operator of a buried utility or to automatically stop the auger before the cutting surface contacts the buried utility.

25 Claims, 7 Drawing Sheets

ROTARY RAPID EXCAVATION SYSTEM

BACKGROUND OF THE INVENTION

1. Field of the Invention

This invention relates generally to methods and apparatus for earth excavation with drills and augers, and more particularly to a method and apparatus for rapid earth excavation utilizing drills and augers having soft cutting edges and/or control of the torque and weight of the boring apparatus to prevent damage to buried pipe, cable, and other underground objects.

2. Brief Description of the Prior Art

A considerable portion of the operating budget of gas, electric, and telecommunications industries is spent to maintain and repair the efficiency and safety of the buried distribution system connecting supplies to the end user. It is estimated that the U.S. gas distribution industry alone must maintain an estimated 866,000 miles of distribution mains and 563,000 miles of services with the network expanding at a rate of 9,000 miles a year. The installation, repair, and maintenance of these mains and services is costly, requiring a significant amount of manpower and equipment. It is estimated that the gas industry alone will dedicate over 450 million dollars in 1988 to repair leaks, replace aging lines, and to install corrosion protection.

Several methods are presently used to expose buried pipe, cables, and other utilities for repair and maintenance. Most common among these methods are backhoes and hand digging Backhoes offer the advantage of high speed and minimal setup time but can cause serious damage to utilities contacted by the bucket while it is digging. The size of the excavation produced by the backhoe is often substantially larger than necessary, which increases the cost of restoration. Records filed with the Department of Transportation show that 60% of gas pipe incidents which occurred between 1974 and 1984 were caused by large excavation equipment.

Conversely, hand digging is effective in minimizing damage to buried utility lines, but is slow and highly labor intensive. Vacuum and soft excavators employing vacuum for spoil removal are limited in the range of soils in which they are effective and the speed at which the lines are uncovered.

There are several patents which disclose various methods and apparatus for controlling the torque of the drilling or boring apparatus.

Bricken, U.S. Pat. No. 1,776,779 discloses a well drilling and pumping apparatus with torque control.

Hawk, U.S. Pat. No. 1,904,765 discloses a method of torque control and automatic drill control.

Vanderzee, U.S. Pat. No. 2,594,098 discloses a portable, truck-mounted drilling rig with torque control.

Pokorny, U.S. Pat. No. 2,734,722 discloses a post hole driller with hydraulic controls but no flexible cutting surface or auger.

Goodrich, U.S. Pat. No. 2,981,403 discloses an auger with flexible flights but does not teach using soft flexible materials in the cutting surface.

Rumpp, U.S. Pat. No. 4,458,769 discloses a rock drill having a helical surface for removing cuttings but does not teach using soft flexible materials in the cutting surface or on the flights of an auger.

Warren et al, U.S. Pat. No. 4,660,656 discloses a method and apparatus for controlling torque and a rotary earth drilling bit but does not teach using soft flexible materials in the cutting surface.

Muller, U.S. Pat. No. 4,699,226 discloses an interchangeable conveying spiral which can be removable mounted on a drill shaft for removing rock cuttings out does not teach using soft flexible materials in the cutting surface or on the flights of an auger.

Snyder, U.S. Pat. No. 2,714,500 discloses an impact drill with flexible blades which are used only for a wiping action on the side wall of the hole being drilled. There is no suggestion of using soft flexible materials in the cutting surfaces.

The present invention is distinguished over the prior art in general, and these patents in particular by a rapid earth excavation method and apparatus utilizing drills and augers having soft polymeric material on the cutting edges, control of the torque and weight of the boring apparatus, or an indicator mounted forward of and below the leading cutting surface of the auger to prevent damage to buried pipe, cable, and other underground objects.

SUMMARY OF THE INVENTION

It is therefore an object of the present invention to provide an inexpensive, reliable excavation system for boring holes in soils to access and repair utility systems which combines high boring speed with low damage potential.

It is another object of this invention to provide an excavation system for boring holes in soils which will not damage buried pipe, cable, or other utility lines when contacted during the boring operation.

Another object of this invention is to provide earth drilling apparatus having soft, yieldable polymeric materials on the cutting surfaces to prevent damage to buried pipe, cable, or other utility lines when contacted during drilling operations.

Another object of this invention is to provide earth drilling apparatus having smooth rounded edges appropriately treated to prevent abrasion of buried pipe, cable, or other utility lines when contacted during drilling operations.

Another object of this invention is to provide an earth drilling system wherein the drilling forces and weight of the drilling apparatus is accurately controlled to provide both a full power and torque mode and a weight-limited non-damaging mode of operation.

Another object of this invention is to provide an earth drilling system which provides a positive indication to the operator that a pipe or other buried article substantially different from the native soil has been hit.

Another object of this invention is to provide an earth drilling system which will automatically stop the drilling operation upon contact with a buried pipe or other buried article substantially different from the native soil.

A further object of this invention is to provide an earth drilling system utilizing concentric augers each capable of providing and maintaining a torque adequate to create a given hole diameter but sufficiently below that which would damage typical gas, electric, and telecommunications piping and cables.

A still further object of this invention is to provide an earth drilling system which will aid in preventing damage to buried utilities which is simple in construction, economical to manufacture, and rugged and durable in use.

Other objects of the invention will become apparent from time to time throughout the specification and claims as hereinafter related.

The above noted objects and other objects of the invention are accomplished by the present earth excavation method and apparatus utilizing drills and augers having soft polymeric material on the cutting edges and/or control of the torque and weight of the boring apparatus to prevent damage to buried pipe, cable, and other underground objects.

DESCRIPTION OF THE PREFERRED EMBODIMENTS

Figure 1:
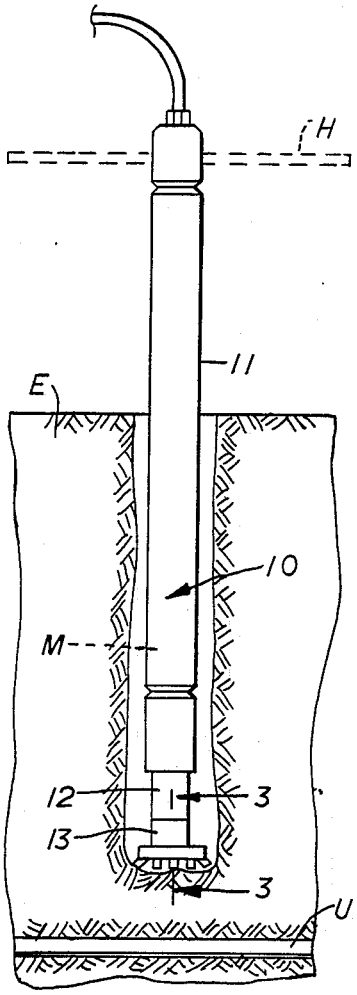
FIG. 1 is a side elevation of a soft drill apparatus in accordance with the present invention positioned above a buried utility cable.

Referring to the drawings by numerals of reference, there is shown schematically in FIG. 1, a buried utility pipe or cable U below a preferred soft drill excavator 10 used to bore holes in the earth E. Soft drill 10 comprises an elongate tubular housing 11 which contains an air motor M such as a 100 psi air rotary drilling motor at its lower end, and a smaller tubular extension or bit box 12 therebelow which is rotated by the motor. A drill bit 13 is mounted on tubular bit box 12. Soft drill 10 utilizes conventional weight indicator, air supply, and control means (not shown) which allow continuous monitoring and control of the tool during drilling operations.

Figure 2:
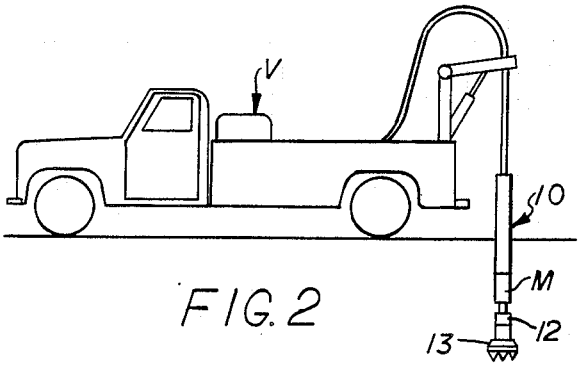
FIG. 2 is a side elevation of a soft drill apparatus mounted at the rear of a vehicle.

Tool 10 is approximately 4 feet in length and weighs approximately 60 pounds and may be used with conventional portable drill rigs (not shown). Because of its size and weight it is also suitable for use as a hand-held tool with the attachment of a transverse handle H as shown in dotted line. The soft drill 10 may also be mounted at the rear of a vehicle V as shown in FIG. 2.

Figure 3:
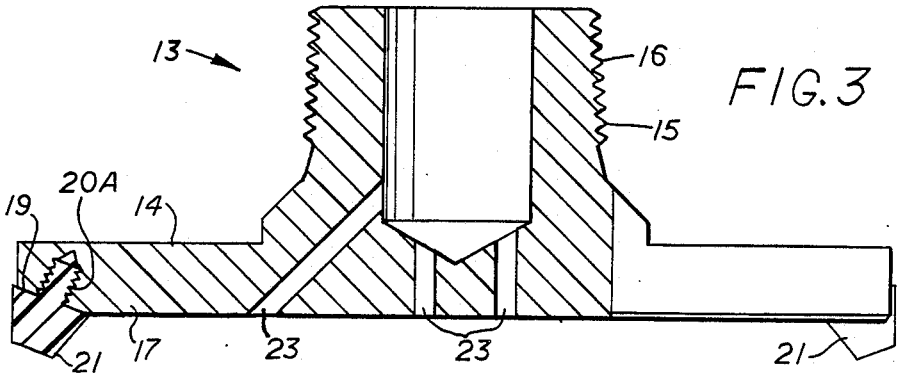
FIG. 3 is a side elevation of the drill bit member of a soft drill apparatus having inserts formed of soft polymeric material in accordance with the present invention.
Figure 4:
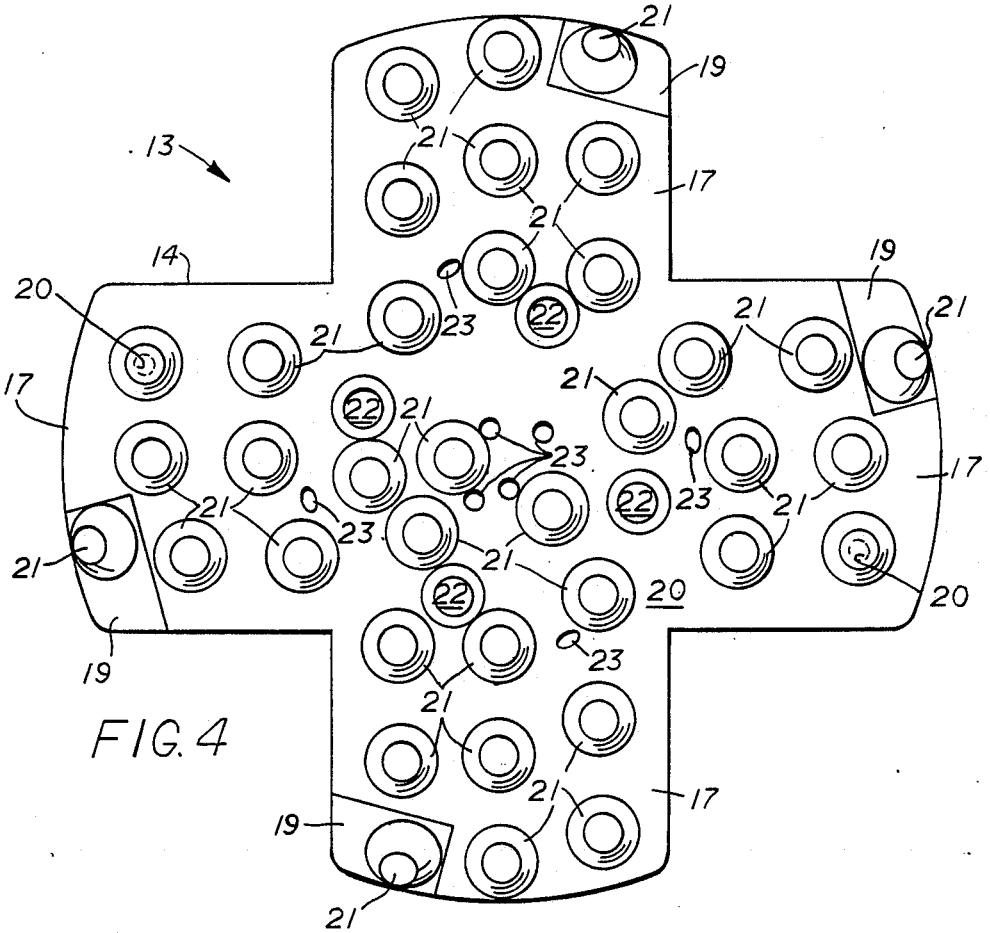
FIG. 4 is a plan view of the bottom of the drill bit of FIG. 3.
Figure 5:
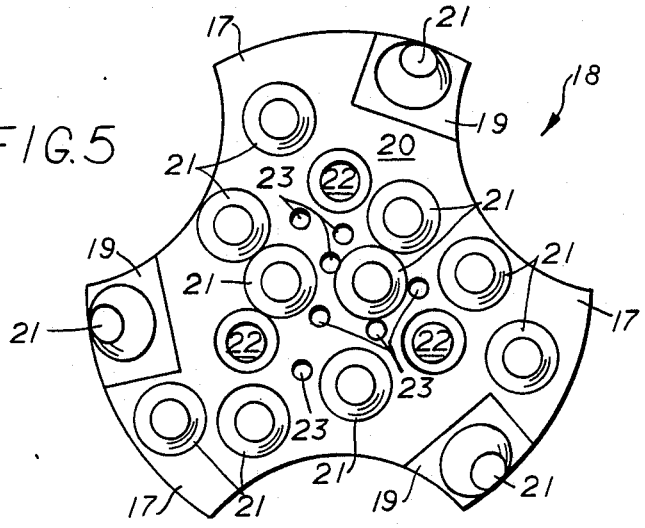
FIG. 5 is a plan view of the bottom of another drill bit having inserts formed of soft polymeric material.

As shown in FIGS. 3, 4, and 5, bit 13 comprises a flat body 14 having a cylindrical upper portion 15 adapted to be mounted on bit box 12 by threads 16 or other conventional mounting means. The bottom of the bit body 14 has radial arms 17, the outer ends of which are rounded to form a circular cutting path. FIG. 5 shows the bottom of a modified drill bit 18 which may be used for smaller diameter holes and has three circumferentially spaced radial arms 17. In each of the embodiments, one corner of each radial arm is chamfered as at 19. The bottom surface 20 of the bit 13 or 18 including the chamfered corners 19 has drilled and tapped holes **20*a*** arranged in a radially outward generally spiral pattern.

A plurality of frustro-conical inserts 21 are threadedly secured in tapped holes **20*a* in the bottom surface of body 14. Inserts 21 protrude normal to the bottom surface of body 14 and the inserts on chamfered portions 19 extend angularly outward beyond the leading edge of the radially extending portions to form the circumferential cutting structure of the bit. Inserts 21** are formed of a suitable soft, yieldable polymeric material, such as 90 durometer polyurethane.

The face, or cutting surface of the bit that first contacts the soil has soft yieldable polymeric inserts 21 which allow it to penetrate into the soil while minimizing its potential to damage buried utility lines. This is made possible by the flexibility and low abrasion of the insert materials. The air motor rotates the bit at a relatively high speed (typically 100–400 RPM). The torque is maintained below a limit which will damage the buried utility expected to be encountered.

A plurality of counterbored nozzle holes 22 extend through the body 14 in communication with air motor M. Conventional nozzle members (not shown) are secured in the holes 22. The nozzle members do not extend beyond the end of the inserts 21. The embodiment of FIG. 5 also has several small holes 23 in communication with the air motor which do not receive nozzles, but instead serve as air nozzles. Air motor M supplies the bit with torque needed for boring and the nozzle holes with air to remove cuttings from the bore hole.

During drilling operations, the weight of the soft drill is controlled manually by vertical operation of the apparatus by which it is suspended and the maximum torque is controlled by a valve which regulates the air pressure to the air motor. When polymeric inserts 21 of the bit contact the buried utility line or pipe, there is no damage to the pipe due to the flexibility and low abrasion of the polymeric insert material. When the bit contacts the buried utility, the drill may be raised.

Preliminary field experiments have demonstrated that this system can rapidly expose utilities under difficult soil conditions. An average drilling rate of from 5 to 6 ft./min. has been achieved with a $4\frac{3}{4}''$ soft face bit in a dry, hardpacked clay. Air from the motor was discharged through and across the face of the bit. The bore holes were blown clean of cuttings without a vacuum system for spoil removal.

ANOTHER EMBODIMENT

FIGS. 6 through 11 illustrate a soft earth-auger system wherein the lower end of the auger is made of a semi-flexible material and/or has relatively blunt or rounded edges to protect against damage. It differs from the soft bit system in that it employs auger flights to clean the hole and is suited to be powered from conventional power take-offs or small gasoline engines.

The key to non-damaging operation is to control the torque of the auger and weight on the auger which may crush buried utilities. The torque is kept below a limit which will damage the buried utility expected to be encountered. Tests conducted on one-half inch polyethylene pipe has shown that the pipe is not damaged so long as the force applied to the pipe is less than approximately 250 pounds. This corresponds to digging torques of 120 ft.-lbs for a 12 inch diameter hole or 180 ft.-lbs for an 18 inch diameter hole.

The soft earth-auger 24 comprises a central elongated tubular shank or shaft 25 which is rotatable in any suitable manner by having its upper end connected to drive means or motor 26 coupled to control means 27 for controlling the speed or rotation thereof. An spiral flight 28 rigidly secured to shaft 25 conveys loose material or spoils axially upward along the shaft from its lower end. As shown, the lowermost portion 29 of flight 28 extends radially outward from shaft 25 to form the cutting surface of the auger that first contacts the soil.

Figure 7:
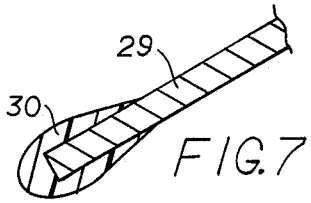
FIGS. 7 and 8 are partial cross sections showing details of the soft polymeric material on the leading cutting surface of the auger flight.
Figure 8:
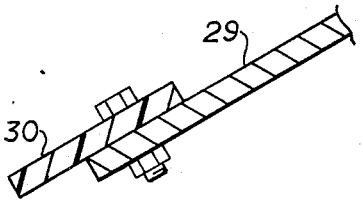
Figure 9:
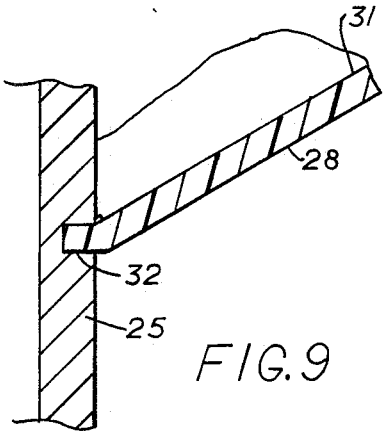
FIGS. 9, 10, and 11 are partial cross sections showing auger flights formed of soft polymeric material.
Figure 10:
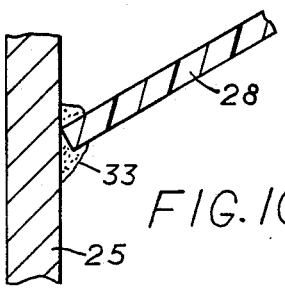
Figure 11:
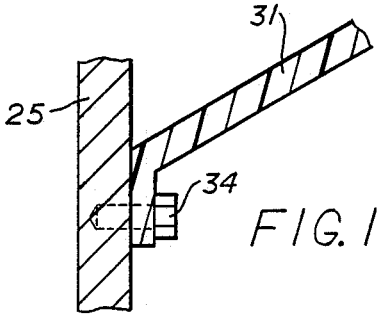

The leading edge of the lowermost portion 29 of flight 28 is of a soft polymeric material 30 while the remaining portion of the flight is formed of other more rigid materials such as metal. The polymeric material 30 may be installed on the leading edge flight 28 by dipping or coating as seen in FIG. 7, or as shown in FIG. 8 may comprise a strip of polymeric material bolted to the leading edge of the flight. The outer portion may have rounded edges if formed of relatively rigid polymeric material, or if formed of softer materials, may have blunt edges. In FIG. 9, the entire flight 28 is formed of an elongate strip 31 of suitable soft yieldable polymeric material such as 90 durometer polyurethane. The strip 31 of polymeric material may be secured to the shaft 25 by various conventional means such as installing the inward edge of the strip in a spiral groove 32 (FIG. 9), bonding with epoxy cement 33 (FIG. 10), or by bolts 34 (FIG. 11), to provide a continuous spiraled flight.

The feature of the auger having the cutting edge which first contacts the soil formed of polymeric material allows it to sufficiently penetrate into the soil while minimizing its potential to damage buried utility lines. This is made possible by the flexibility and low abrasion of the polymeric flight material.

Figure 6:
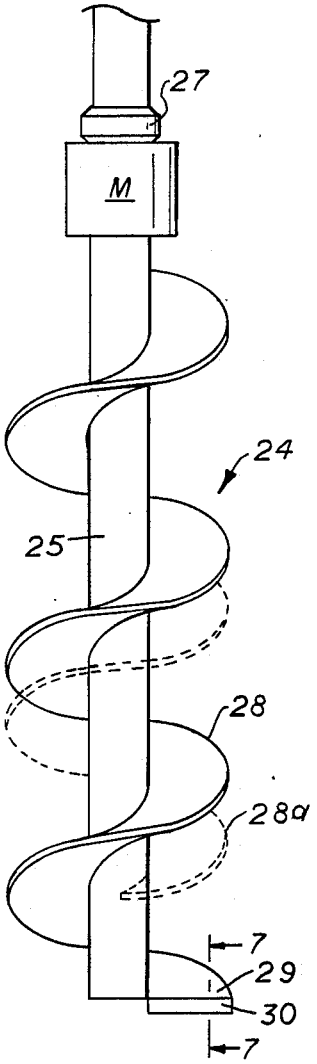
FIG. 6 is a side elevation of an earth auger apparatus having soft polymeric material on the leading cutting surface of the flight.

In FIG. 6, the soft earth-auger 24 may have a dual flight **28*a* (dotted) on at least the lower section of the auger to balance the torque load during digging and prevent the twisting or moment induced in single-flight augers. In this embodiment, the auger may have the entire flights or the leading edge of the lowermost flight formed of a suitable polymeric material such as 90 durometer polyurethane as previously described with reference to FIGS. 7–11. Secondary flight 28*a*** may be formed of conventional metal materials, or may also be formed of the polymeric materials described above.

AUGER WITH RING INSERTS

Figure 12:
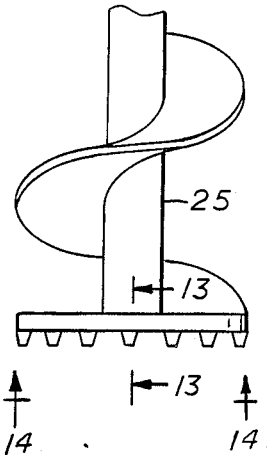
FIG. 12 is a side elevation of the lower portion of an auger equipped with inserts formed of soft polymeric material.
Figure 13:
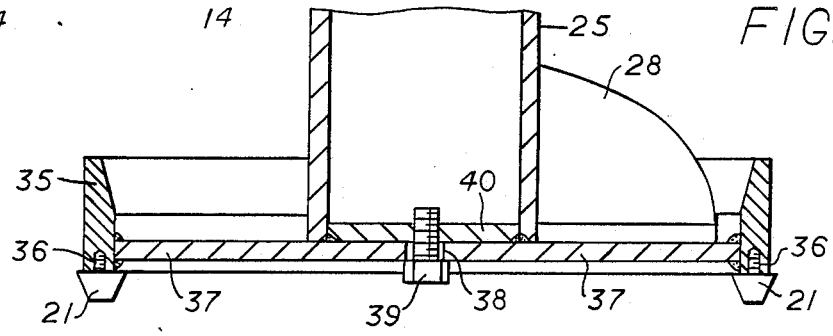
FIG. 13 is a cross section of the auger of FIG. 12.
Figure 14:
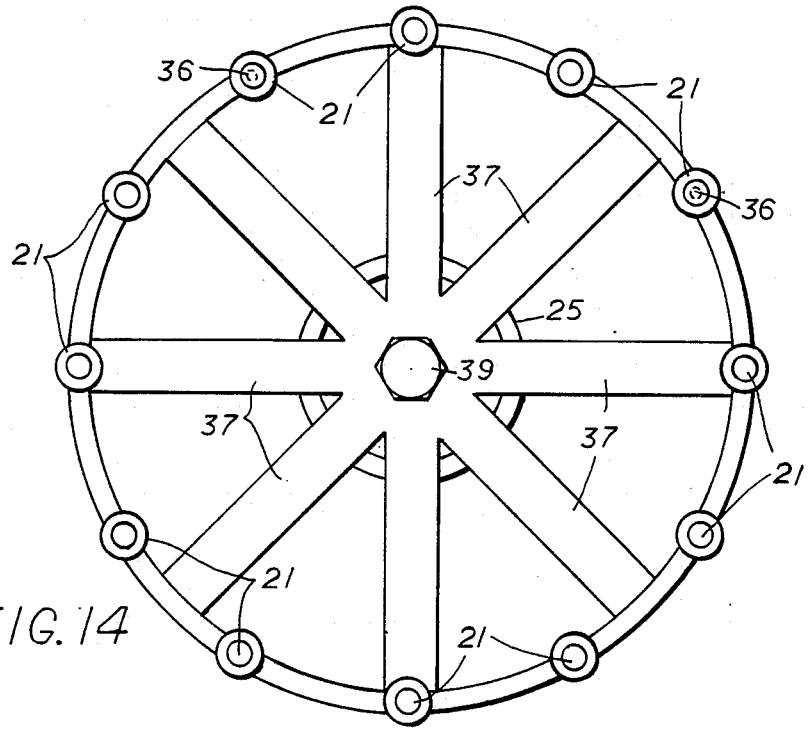
FIG. 14 is a plan view of the bottom of the auger of FIG. 12.

A modification of the soft earth-auger is shown in FIGS. 12, 13, and 14 wherein a circular ring 35 is secured to the bottom of the auger shaft 25 beneath the leading edge of the flight 28 and has a plurality of frustro-conical inserts 21 secured thereon. The bottom surface of the circular ring 35 has a plurality of circumferentially spaced drilled and tapped holes 36. A plurality of frustro-conical inserts 21 are threadedly secured in the tapped holes 36 to protrude vertically from the bottom surface of the ring 35 beyond the leading edge of the flight 28 to form the initial circular cutting path of the auger. The inserts 21 are formed of a suitable soft, yieldable polymeric material, such as 90 durometer polyurethane.

A plurality of straps 37 extend radially from the center of the ring 35 and their outer ends are welded to the interior diameter of the ring to reinforce and strengthen the ring against deformation. The straps 37 also provide a flat surface by which the ring may be welded to the bottom of the shaft 25. The straps 37 of the ring 35 may also be provided with a central hole 38 through which a bolt 39 is passed and threadedly secured into another strap 40 secured in the bottom of the shaft 25.

Thus the ring 35, or leading structure of the auger that first contacts the soil has soft yieldable polymeric inserts 21 which allow it to penetrate into the soil while minimizing its potential to damage buried utility lines.

The soft earth-auger system can be used in either torque limited or full-power mode. The advantage to the latter is that highly consolidated or strong materials such as baked clays, caliche, rocky soils, or rock may be drilled with the same equipment so long as it is known that buried utilities will not be encountered.

DUAL CONCENTRIC AUGER

A digging torque of 300 ft.-lbs is commonly used in drilling an 18 inch diameter hole, however, this much torque will damage the pipe if applied by a single member. Therefore, it would be advantageous to split the torque into quantities sufficient for digging but small enought to prevent damage to the pipe. Test results have determined that a digging torque of 120 ft.-lbs is adequate for a 12 inch diameter hole and that 180 ft.-lbs of torque is adequate for an 18 inch diameter hole, however in some clay soils, the 120 ft.-lb torque is adequate for a 12 inch diameter hole but the 180 ft.-lb torque is insufficient for a single-pass 18 inch diameter hole. In this type of soil condition, the boring operations may be carried out using a 12 inch earth-auger to create a 12 inch diameter hole in the "torque-limited" mode (120 ft.-lbs) and then enlarging the 12 inch diameter hole to 18 inches in diameter in a second, sequential pass in the "full-power" mode (180 ft.-lbs).

Figure 16:
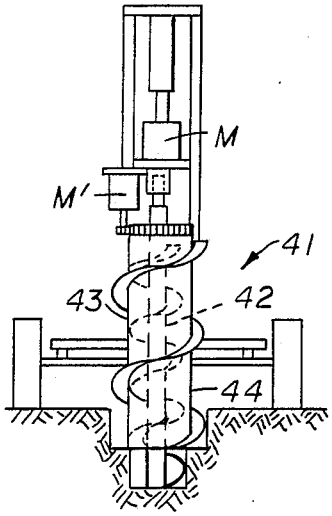
FIGS. 15 and 16 are illustrations of a dual concentric auger system having a small earth-auger rotatably mounted inside the shaft of a larger auger.
Figure 15:
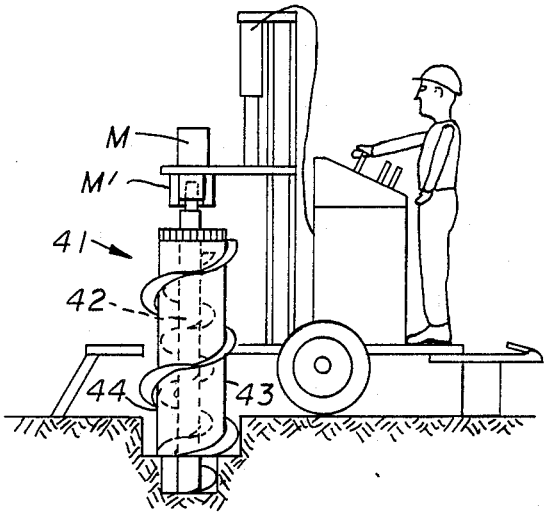
Figure 17:
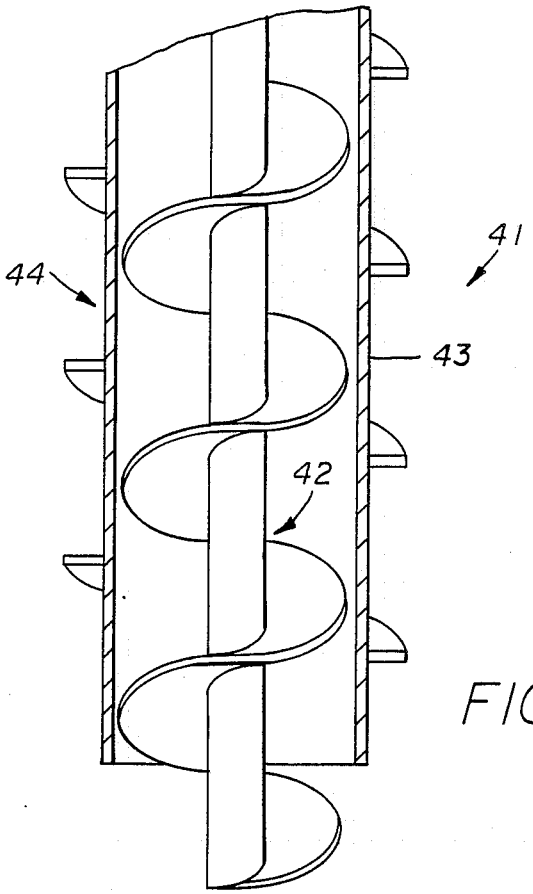
FIG. 17 is a longitudinal cross section of the auger system of FIGS. 15 and 16.
Figure 18:
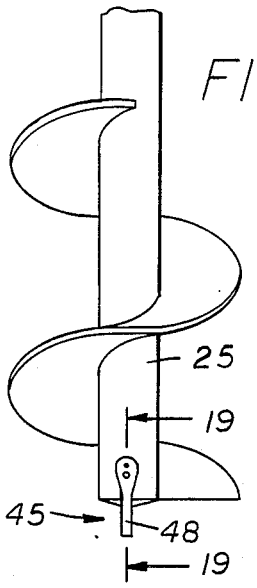
FIGS. 18 through 24 illustrate earth auger systems having an indicator mounted forward of and below the leading cutting surface of the auger to warn the operator of a buried utility or to automatically stop the auger before the cutting surface contacts the buried utility.
Figure 21:
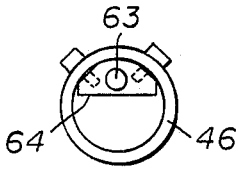
Figure 20:
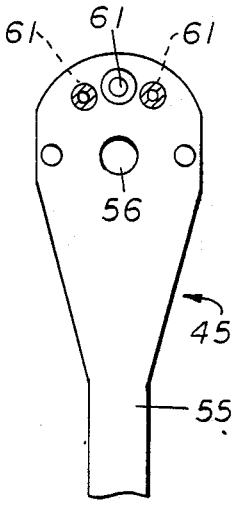
Figure 19:
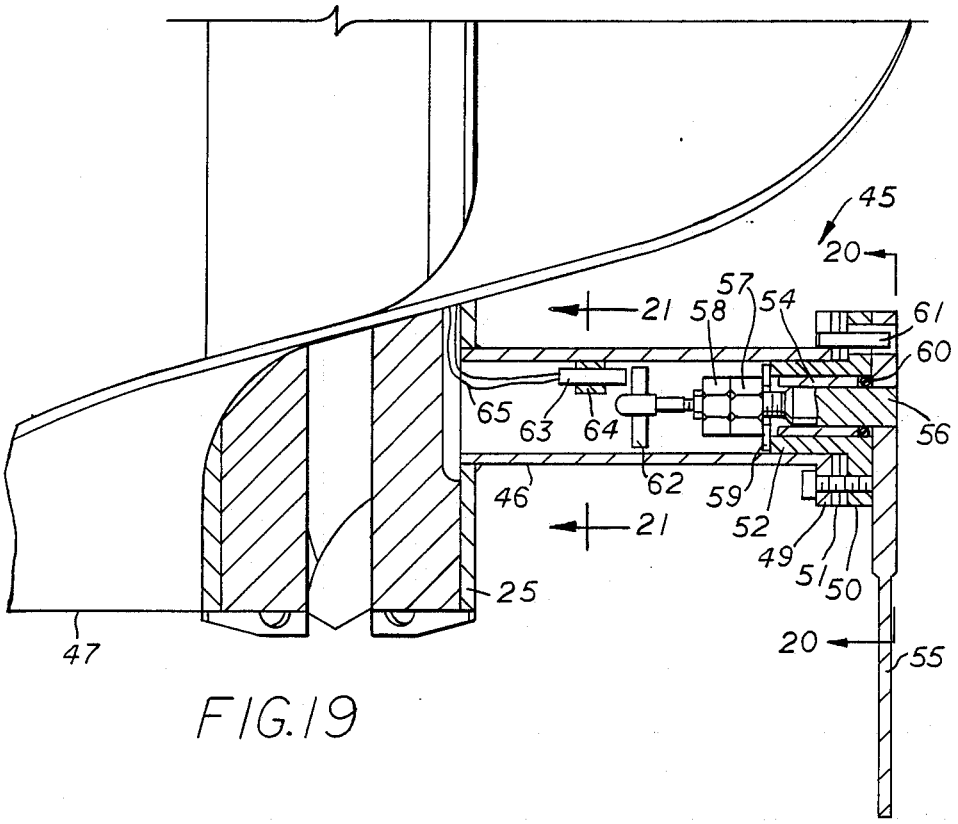

Another embodiment of the rapid excavation earth-auger system, a dual concentric auger 41 is used to create the smaller and larger holes. As shown in FIGS. 15, 16 and 17, a 12 inch earth-auger 42 is rotatably mounted inside the shaft 43 of an 18 inch auger 44 and extends therebelow. The two augers 42 and 44 are physically separated whereby only one of the augers will contact a buried utility at any particular instant. Both augers drill simultaneously with the lower, 12 inch diameter auger 42 providing a pilot to guide the upper, 18 inch enlarging auger 44. Each auger is driven independently by individual hydraulic motors M and M' which allows the torque required to create the hole to be divided in such a manner as to prevent damage to contacted utilities. For example, the 12 inch auger 42 may have a digging torque of 120 ft.-lbs and the 18 inch auger 44 may have a digging torque of 180 ft.-lbs.

AUGER WITH INDICATOR

FIGS. 18 through 24 illustrate an earth auger system wherein an indicator is mounted forward of and below the leading cutting surface of the auger to warn the operator of a buried utility or to automatically stop the auger before the cutting surface contacts the buried utility. The indicator may be used with the previously described soft earth-augers or conventional augers made of hardened steel materials. In this application, the drilling torque of the auger need not be limited.

FIGS. 18 through 21 show an indicator 45 comprising a radially extending tubular housing 46 secured to the shaft 25 of the auger just above the cutting edge 47 and has a flange 49 at the outer end. A second flange 50 is bolted to the flange 49 and seals 51 are disposed between the mating surfaces. The flange 50 has a reduced diameter tubular neck portion 52 which is received within the tubular housing 46. A tubular bushing 54 is disposed within the neck 52. A lever 55 is pivotally mounted on the flange 50 at the outer end of the housing 46. A shaft 56 is secured to the lever 55 and extends inwardly from one side to be received in the bushing 54. The inner end of the shaft 56 is threaded and receives a nut 57 and locknut 58.

A bearing 59 is captured between the nut 57 and the end of the neck 52. An 0-ring 60 is disposed between outward end of the bushing 54 and the inward face of the lever 55. One or more shear pins 61 are installed between the flanges 49 and 50 and the top portion of the lever 55. A magnet 62 is secured to the threaded end of the shaft 56 to rotate therewith. A sensor switch 63 is mounted in a bracket 64 secured to the interior of the tubular housing 46. Wires 65 connected to the switch 64 run upwardly inside the auger shaft and are connected to an audible or visual alarm device (not shown) which will alert the operator.

As the auger rotates, lever 55 cuts a small circular track below the cutting plane of the auger bottom. Lever 55 attached by a shear pin allows the blade to be released or swing away from the obstacle encountered upon predetermined force resulting from contacting the utility. As the arm swings upward, magnet 62 rotates to close switch 63 and trigger the alarm device alerting the operator to stop drilling. The switch may also complete another circuit to automatically stop the auger. It should be understood that the lever may also be connected to the auger by a clutch or detent mechanism rather than shear pins.

Figure 22:
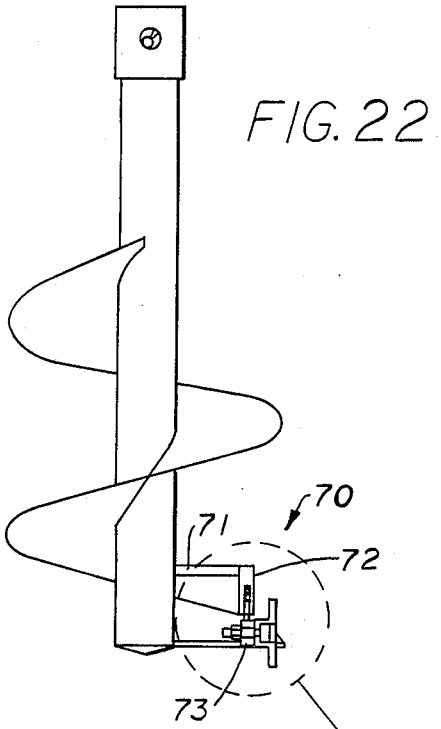
Figure 23:
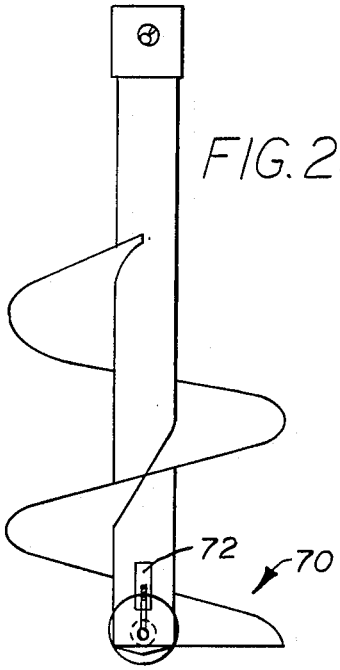
Figure 24:
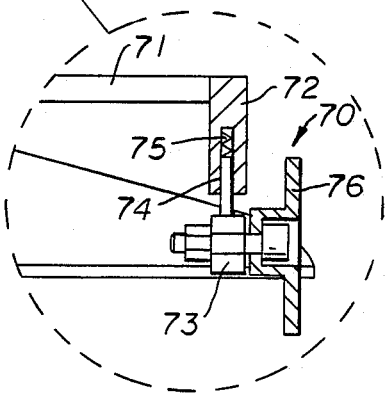

FIGS. 22, 23, and 24 show an indicator 70 comprising a radially extending arm 71 secured to shaft 25 of the auger just above cutting edge 47 and has a depending tubular housing 72 secured at the extended end. A connecting bracket 73 has an upper rod 74 slidably connected through the bottom of housing 72 and is urged downward by a compression spring 75 contained in housing 72 and biased against rod 74. A small wheel or roller 76 is rotatably journaled to the lower portion of bracket 73 near the outermost edge of the cutting surface of the auger flight. Roller 76 is vertically positioned whereby the lower end is maintained below the lower cutting edge by the spring force.

Roller 76 penetrates the soil to a depth proportional to pressure applied to its contacting face and the soil strength as the auger is rotated. The spring is selected to provide a force adequate to force the wheel into the ground but which is sufficiently small in magnitude to prevent damage to the pipe. Upon contacting the buried line, the wheel is forced upward over it as it rolls which, in turn, triggers either an alarm mechanism at the top portion of the auger or circuit to stop the auger as described above. It should be understood that the wires and other delicate components of the trigger mechanism would be run through the inside of the shaft of the auger to prevent them from being damaged.

The indicator devices minimize and/or prevent damage to buried piping because of the low force required to advance the indicator lever or roller through the soil and its geometric location which assures that it is the first member to contact the buried utility. The latter provides sufficient time and means to stop the advance of the main cutting surfaces before damage can occur. Because of their small soil contact surfaces, both embodiments of the indicator system (lever or wheel) allow full power to be supplied to the auger for rapid excavation. Thus both rapid excavation and minimizing the possibility of damage to the utility are achieved.

While this invention has been described fully and completely with special emphasis upon a preferred embodiment, it should be understood that within the scope of the appended claims the invention may be practiced otherwise than as specifically described herein.

We claim:

1. Apparatus for boring holes in the earth comprising:
a shaft,
means for rotating said shaft, and
earth boring means supported on said shaft and having a plurality of cutting members mounted thereon,
all of said cutting members of said earth boring means being made of soft flexible polymeric material
said soft flexible polymeric material being sufficiently strong to cut the earth without breaking and sufficiently flexible and non-abrasive to prevent damage to buried pipe or cable or other buried article substantially different from the native soil upon contact of said boring means therewith.

2. Apparatus according to claim 1 including
a tubular supporting housing for said shaft, and
said rotating means comprises an air motor within said tubular housing for rotating said boring means at a predetermined torque.

3. Apparatus according to claim 1 including
means to rotate said shaft and said boring means at a predetermined torque.

4. Apparatus for boring holes in the earth comprising;
a shaft,
means for rotating said shaft, and
earth boring means comprising an elongated spiral auger flight rigidly secured to said shaft for conveying material from the bore hole during operation,
said flight extending laterally outwardly from and longitudinally along said shaft and having soft polymeric material on at least a leading edge which first contacts the earth and cuts the bore hole,
said soft flexible polymeric material being sufficiently strong to cut the earth without breaking and sufficiently flexible and non-abrasive to prevent damage to buried pipe or cable or other buried article substantially different from the native soil upon contact of said boring means therewith.

5. Apparatus according to claim 4 in which
the mass of soft polymeric material is placed on said leading edge by a dipping process.

6. Apparatus according to claim 4 in which
the mass of soft polymeric material is formed on said leading edge by a coating process.

7. Apparatus according to claim 4 in which
the soft material on the leading edge of said flight comprises a strip of soft polymeric material secured on said leading edge to form a forward extension thereof.

8. Apparatus according to claim 4 in which said spiral flight is formed of soft polymeric material secured on said shaft.

9. Apparatus according to claim 8 in which said spiral flight is secured on said shaft by bolts.

10. Apparatus according to claim 8 in which said spiral flight is bonded to said shaft.

11. Apparatus according to claim 8 in which said spiral flight is secured in a circumferential spiral groove formed in the exterior surface of said shaft.

12. Apparatus according to claim 1 in which;

said earth boring means comprises an elongated spiral auger flight rigidly secured to said shaft for conveying material from the bore hole as it is bored, said flight extending laterally outwardly from and longitudinally along said shaft, and a cylindrical ring member secured at the bottom of said flight and extending below the leading edge thereof, said cylindrical ring member having said cutting members thereon.

13. Apparatus for boring holes in the earth comprising;

a shaft, means for rotating said shaft, earth boring means comprising an elongated spiral auger flight rigidly secured to said shaft for conveying material from the bore hole as it is bored and having a portion engagable with the earth for cutting a bore hole, said flight extending laterally outwardly from and longitudinally along said shaft, and a cylindrical ring member secured at the bottom of said flight and extending below the leading edge thereof, said cylindrical ring member having soft flexible polymeric material forming cutting inserts depending from its bottom surface which first contacts the earth and cuts the bore hole path, and said soft flexible polymeric material being sufficiently strong to cut the earth without breaking and sufficiently flexible and non-abrasive to prevent damage to buried pipe or cable or other buried article substantially different from the native soil upon contact of said boring means therewith.

14. Apparatus according to claim 4 including;

a second axially elongated hollow shaft concentrically surrounding the first stated axially elongated shaft member and having rotating means at one end for rotating the second shaft independently of the said first stated shaft, and earth boring means at its opposite end larger in diameter and positioned above the earth boring means of said first stated shaft, whereby said earth boring means of said first stated shaft first contacts the earth and cuts a first bore hole path of one diameter and the earth boring means of said second shaft enlarges the bored hole to a larger diameter.

15. Apparatus according to claim 14 in which said first and second shafts each having their upper end adapted to be separately engaged to rotating means to cause rotation of the respective shaft and its associated boring means independently of the other at different predetermined torques, whereby each said shaft is capable of providing and maintaining a torque adequate to create a given hole diameter but sufficiently below that which would cause damage to buried pipe or cable or other buried article substantially different from the native soil upon contact of said boring means therewith.

16. Apparatus for boring holes in the earth comprising;

a shaft, means for rotating said shaft, and earth boring means supported on said shaft and having a portion engagable with the earth for cutting a bore hole, said earth boring means having soft flexible polymeric material on at least the portion which first contacts the earth and cuts the bore hole, said soft flexible polymeric material being sufficiently strong to cut the earth without breaking and sufficiently flexible and non-abrasive to prevent damage to buried pipe or cable or other buried article substantially different from the native soil upon contact of said boring means therewith, said earth boring means comprises an elongated spiral auger flight with a leading edge cutting surface rigidly secured to said shaft for conveying material from the bore hole during operation, said flight extending laterally outwardly from and longitudinally along said shaft, and indicator means movably mounted forward of and below the leading cutting surface of said flight and operatively connected to warning means for warning the operator prior to the cutting surface contacting buried pipe or cable or other buried article substantially different from the native soil upon contact of said indicator means therewith.

17. Apparatus according to claim 16 in which;

said indicator means comprises a thin rectangular lever member pivotally connected to said shaft in a spaced parallel relation therewith and having a bottom end terminating forward of and below the leading cutting surface of said flight, said warning means comprises switch means operatively connected between the upper end of said lever member and an alarm device remote from said lever member, whereby said lever member cuts a circular path below the cutting plane of said flight as said shaft rotates and said lever member will pivot sufficiently upon contacting buried pipe or cable or other buried article substantially different from the native soil to actuate said switch means thereby closing a circuit to activate said alarm device to warn the operator.

18. Apparatus according to claim 16 in which;

said indicator means comprises a thin rectangular lever member pivotally connected to said shaft in a spaced parallel relation therewith and having a bottom end terminating forward of and below the leading cutting surface of said flight, said warning means comprises switch means operatively connected between the upper end of said lever member and said rotating means, whereby said lever member cuts a circular path below the cutting plane of said flight as said shaft rotates and said lever member will pivot sufficiently upon contacting buried pipe or cable or other buried article substantially different from the native soil to actuate said switch means thereby closing a circuit to stop the rotation of said rotating means.

19. Apparatus according to claim 16 in which;

said indicator means comprises a roller member connected to said shaft in a spaced parallel relation therewith and having an axis of rotation transverse to the longitudinal axis of said shaft, said roller member rotatably mounted on a vertically movable rod member and the roller positioned forward of and partially below the leading cutting surface of said flight, resilient spring means connected on said rod member to normally maintain lower portion of said roller member below the cutting edge by the spring force thereof, said warning means comprises switch means operatively connected between the upper end of said rod member and an alarm device remote from said roller member, whereby said roller member penetrates the soil below the cutting plane of said flight and said rod moves upward upon contacting buried pipe or cable or other buried article substantially different from the native soil to actuate said switch means and close a circuit to activate said alarm device.

20. Apparatus according to claim 16 in which;

said indicator means comprises a roller member connected to said shaft in a spaced parallel relation therewith and having an axis of rotation transverse to the longitudinal axis of said shaft, said roller member rotatably mounted on a vertically movable rod member and the roller member positioned forward of and partially below the leading cutting surface of said flight, resilient spring means connected on said rod member to maintain lower portion of said roller member below the cutting edge by the spring force thereof, said warning means comprises switch means operatively connected between the upper end of said rod member and said rotating means, whereby said roller member penetrates the soil in a circular path below the cutting plane of said flight as said shaft rotates and said rod member will move vertically upward upon contacting buried pipe or cable or other buried article substantially different from the native soil to actuate said switch means thereby closing a circuit to stop the rotation of said rotating means.

21. Apparatus for boring holes in the earth comprising;

a shaft, an elongated spiral auger flight with a leading edge cutting surface rigidly secured to said shaft for conveying material from the bore hole during operation, said flight extending laterally outwardly from and longitudinally along said shaft, and indicator means movably mounted forward of and below the leading edge cutting surface of said flight and operatively connected to warning means for warning the operator prior to the cutting surface contacting buried pipe or cable or other buried article substantially different from the native soil upon contact of said indicator means therewith.

22. Apparatus according to claim 21 in which;

said indicator means comprises a thin rectangular lever member pivotally connected to said shaft in a spaced parallel relation therewith and having a bottom end terminating forward of and below the leading cutting surface of said flight, said warning means comprises switch means operatively connected between the upper end of said lever member and an alarm device remote from said lever member, whereby said lever member cuts a circular path below the cutting plane of said flight as said shaft rotates and said lever member will pivot sufficiently upon contacting buried pipe or cable or other buried article substantially different from the native soil to actuate said switch means thereby closing a circuit to activate said alarm device to warn the operator.

23. Apparatus according to claim 21 in which;

said indicator means comprises a thin rectangular lever member pivotally connected to said shaft in a spaced parallel relation therewith and having a bottom end terminating forward of and below the leading cutting surface of said flight, said warning means comprises switch means operatively connected between the upper end of said lever member and said rotating means, whereby said lever member cuts a circular path below the cutting plane of said flight as said shaft rotates and said lever will pivot sufficiently upon contacting buried pipe or cable or other buried article substantially different from the native soil to actuate said switch means thereby closing a circuit to stop the rotation of said rotating means.

24. Apparatus according to claim 21 in which;

said indicator means comprises a roller member connected to said shaft in a spaced parallel relation therewith and having an axis of rotation transverse to the longitudinal axis of said shaft, said roller member rotatably mounted on a vertically movable rod member and the roller member positioned forward of and partially below the leading cutting surface of said flight, resilient spring means connected on said rod member to normally maintain lower portion of said roller member below the cutting edge by the spring force thereof, said warning means comprises switch means operatively connected between the upper end of said rod member and an alarm device remote from said roller member, whereby said roller member penetrates the soil below the cutting plane of said flight and said rod member moves upward upon contacting buried pipe or cable or other buried article substantially different from the native soil to actuate said switch means and close a circuit to activate said alarm device.

25. Apparatus according to claim 21 in which;

said indicator means comprises a roller member connected to said shaft in a spaced parallel relation therewith and having an axis of rotation transverse to the longitudinal axis of said shaft, said roller member rotatably mounted on a vertically movable rod member and the roller member positioned forward of and partially below the leading cutting surface of said flight, resilient spring means connected on said rod member to maintain said roller member below the cutting edge by the spring force thereof, said warning means comprises switch means operatively connected between the upper end of said rod member and said rotating means, whereby said roller member penetrates the soil in a circular path below the cutting plane of said flight as said shaft rotates and said rod member will move vertically upward upon contacting buried pipe or cable or other buried article substantially different from the native soil to actuate said switch means thereby closing a circuit to stop the rotation of said rotating means.

* * * * *